US005873492A

United States Patent [19]

Sullivan

[11] Patent Number: 5,873,492

[45] Date of Patent: Feb. 23, 1999

[54] DISPENSING BAG FOR DYNAMIC MIXER

[75] Inventor: Jerry Sullivan, Mahwah, N.J.

[73] Assignee: Coltene/Whaledent, Inc., Mahwah, N.J.

[21] Appl. No.: 788,455

[22] Filed: Jan. 28, 1997

[51] Int. Cl.[6] ..... B65D 35/56

[52] U.S. Cl. ..... 222/105; 222/107; 222/570

[58] Field of Search ..... 222/92, 95, 105, 222/107, 135, 137, 325, 326, 386, 570

[56] References Cited

U.S. PATENT DOCUMENTS

| | | | |
|---|---|---|---|
| Re. 34,243 | 5/1993 | Gerber | 604/247 |
| 4,949,872 | 8/1990 | Heaps, Jr. | 222/105 |
| 5,012,956 | 5/1991 | Stoody | 222/95 X |
| 5,033,655 | 7/1991 | Brown | 222/212 |
| 5,080,138 | 1/1992 | Haviv | 137/853 |
| 5,092,855 | 3/1992 | Pardes | 604/247 |
| 5,099,885 | 3/1992 | Nilsson | 137/852 |
| 5,249,862 | 10/1993 | Herold | 366/312 |
| 5,265,847 | 11/1993 | Vorhis | 251/342 |
| 5,286,105 | 2/1994 | Herold | 366/177 |
| 5,305,786 | 4/1994 | Debush | 137/512.3 |
| 5,332,122 | 7/1994 | Herold | 222/105 |
| 5,346,108 | 9/1994 | Pasinski | 222/494 |
| 5,398,853 | 3/1995 | Latham | 222/491 |
| 5,501,368 | 3/1996 | Brandhorst | 222/95 |
| 5,697,524 | 12/1997 | Sedlmeier | 222/105 X |

*Primary Examiner*—Gregory L Huson
*Attorney, Agent, or Firm*—Helfgott & Karas

[57] ABSTRACT

A pliable dispensing bag containing a flowable material includes an internal rigid adapter plate having an offset or asymmetric integral nozzle through which the flowable material may be extruded. The deformable material of the bag is clamped around a collar provided at the base of the nozzle so as to form a permanent first leakproof seal. Additional material from the foil bag is gathered at the top of a cap fitted over the nozzle and clamped against the top of the cap to form a removable or temporary second seal and to further hold the cap in place on the nozzle.

27 Claims, 6 Drawing Sheets

DISPENSING BAG FOR DYNAMIC MIXER

BACKGROUND OF THE INVENTION

Field of the Invention

The present invention relates in general to a deformable container for storing and dispensing flowable material and relates in particular to a pliable foil bag provided with an internal adapter plate and a capped spout each sealed within the bag.

Description of Prior Developments

Dispensing bags for dynamic mixers have been used to store various fluids and assorted viscous materials prior to such materials being mixed with other chemically reactive materials. For example, adhesives such as epoxy glue and dental molding materials are typically produced from a mixture of a base material and a catalyst material which are combined in a dynamic mixer and dispensed as required.

Dynamic mixers are used to mix and meter such materials by squeezing or pressing on each dispensing bag at a controlled rate. Material from each bag is channeled into a mixing blade assembly where the two components are mixed, reacted and dispensed.

Examples of such dynamic mixers are disclosed in U.S. Pat. Nos. 5,286,105 and 5,249,862 which are incorporated herein by reference. Although these mixers perform satisfactorily, the foil bags which are used to charge the mixers with reactive materials can leak around their open ends.

This leakage problem has been recognized, but a fully satisfactory solution has not previously been achieved. Attempts to solve such leakage problems are disclosed in U.S. Pat. Nos. 5,501,368 and 5,332,122 which are incorporated herein by reference. The foil bags disclosed in these patents are provided with various collars or sealing rings for preventing the material being dispensed from leaking within their housing or container.

Pressure applied by a dispensing apparatus is used to maintain the seal between the sealing ring and the container which houses the bags. Such bags are designed to be connected to an intermediate cap which has an outlet nozzle or spout which in turn is connected to a mixer or dispenser. Thus, two seals must be maintained with these bags, one against the housing and one within the intermediate cap.

Accordingly, a need exists for a leak-free dispensing bag for dispensing fluids and viscous materials from various dispensing apparatus such as the dynamic mixers noted above.

A further need exists for such a dispensing bag which eliminates the need for connecting and sealing the bag to a dispenser housing such as a housing connected to a dynamic mixer.

A still further need exists for such a dispensing bag which provides a double seal to protect the material within the bag from contamination.

SUMMARY OF THE INVENTION

The present invention has been developed to fulfill the needs noted above and therefore has as an object the provision of a deformable dispensing bag adapted for use with dynamic mixers and other dispensing apparatus and which virtually eliminates leakage of the material or materials being dispensed.

Another object of the invention is to provide a pliable foil dispensing bag which includes an internal adapter having an integral nozzle or spout which may be directly connected to the intake port of a dispenser such as a dynamic mixer.

Another object of the invention is the provision of a dispensing bag for use with a dynamic mixer or other dispenser and which includes two separate seals, one permanent and one temporary, for protecting the contents of the bag from contamination.

These and other objects are met by the present invention which includes a deformable bag within which is sealed a quantity of flowable material. A rigid adapter plate is disposed inside the bag on top of the flowable material. The adapter plate is formed with a collar which extends into an outlet nozzle.

The collar is provided with a pair of axially spaced annular flanges between which an external clamp band is constricted for clamping the foil bag around the collar. This forms a first seal.

A removable cap is fitted over the nozzle and the remaining bag material is clamped and sealed over the cap with a second clamp band. This forms a second seal. The dispensing bag may be opened by cutting the bag material around the base of the cap and removing the cap. The nozzle may then be inserted directly into the intake port of a dynamic mixer or other dispensing apparatus.

In an alternate embodiment, a third seal may be formed by clamping the bag material around the base of the adapter plate. This arrangement virtually eliminates the leakage of flowable material between the adapter plate and the foil bag.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

The present invention will now be described in conjunction with the drawings beginning with FIGS. 1 through 6 which show a dispensing container assembly having a bag 10 filled with a flowable material 12 to a predetermined level within the bag. The bag 10 is preferably formed with a deformable pliable material such as a plastic material or metal foil.

In the embodiment of FIGS. 1 through 6, the bag 10 is shown as a transparent clear plastic material for purposes of illustrating the internal construction of the dispensing container assembly. Although a single ply of material is shown forming bag 10, the bag may be formed with a laminated or composite material.

Material 12 can be any flowable material such as an adhesive, molding material of the type used in dental work or dental impression material. A preferred application of the present invention is for use with a dynamic mixer wherein two dispensing bags 10 are connected to a mixer and the different materials from each bag are blended and mixed and dispensed as a generally homogeneous mixture. However, the dispensing bag 10 according to the invention is equally adaptable for dispensing a single material which does not require mixing with any other material.

Figure 1:
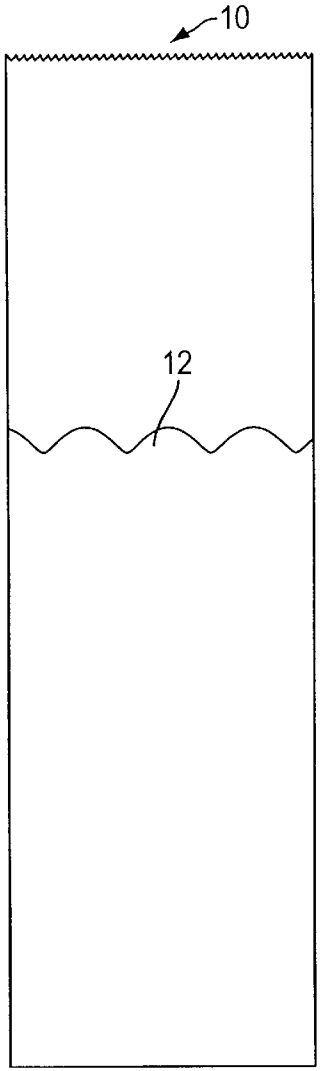
FIG. 1 is a front elevation view showing a deformable foil bag constructed in accordance with the invention and filled with a predetermined amount of material to achieve a correct level within the bag.
Figure 4:
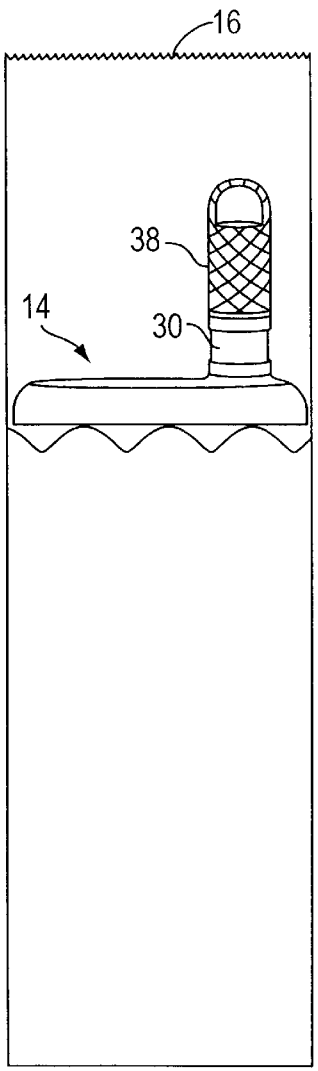
FIG. 4 is a view of the foil bag of FIG. 1 fitted with the adapter plate and cap of FIG. 2.
Figure 2:
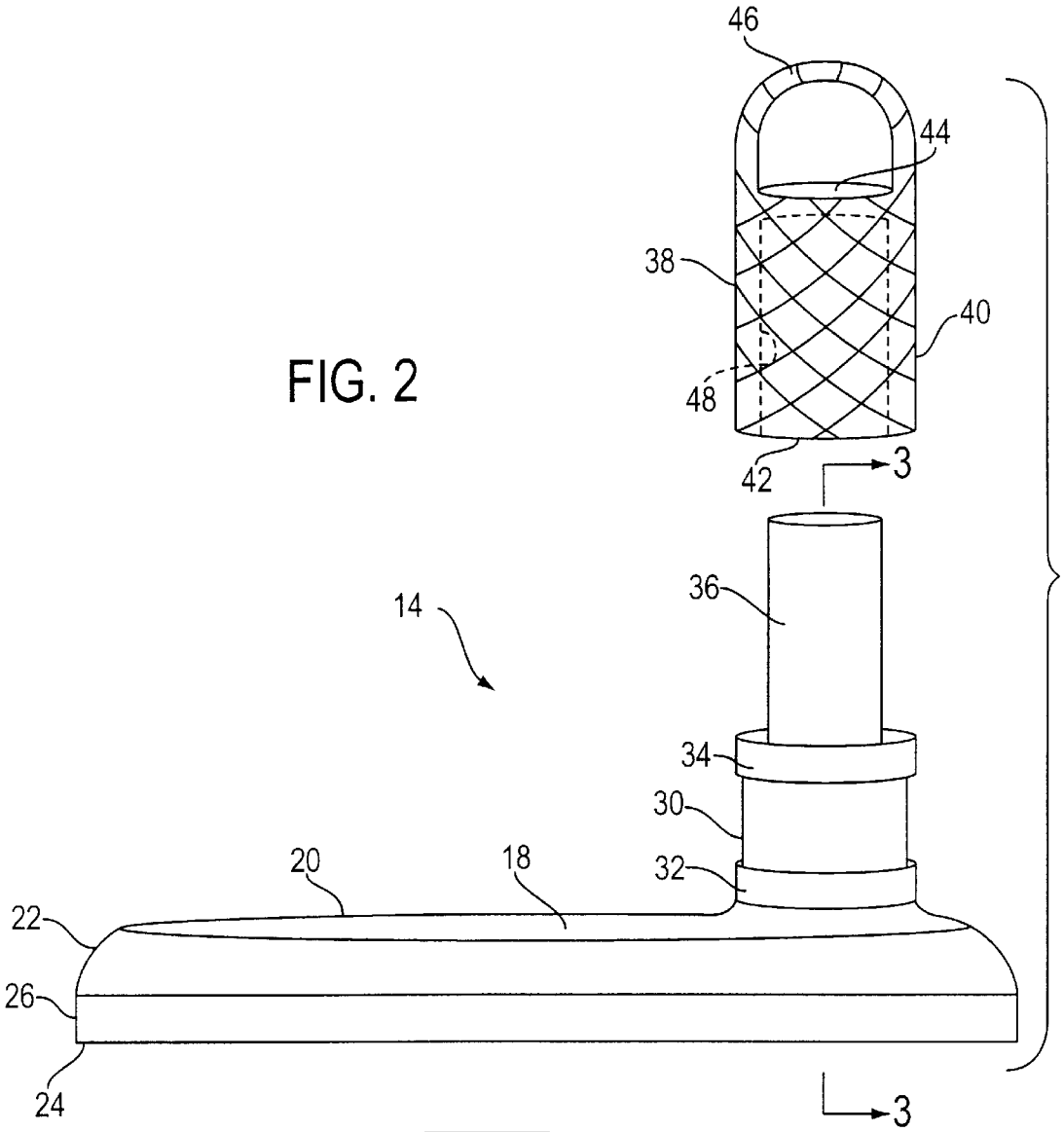
FIG. 2 is an exploded front elevation view of an adapter plate and cap constructed in accordance with the present invention.
Figure 3:
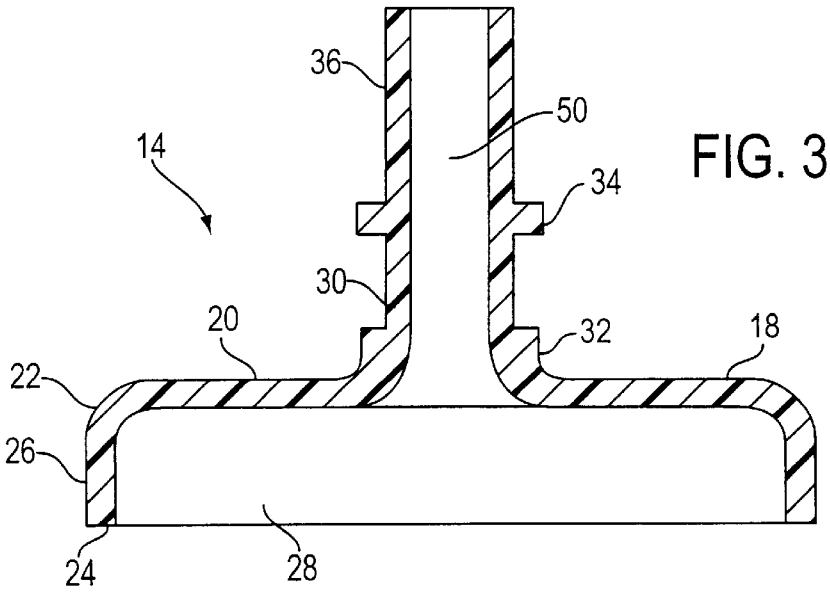
FIG. 3 is a view in section taken through section line 3—3 of FIG. 2.

After the bag 10 is filled with material 12 as shown in FIG. 1, the adapter plate 14 shown in FIGS. 2 and 3 is fitted within the open end 16 of the bag and pressed against the material 12 as shown in FIG. 4. The adapter plate 14 includes a circular lid 18 which is formed with a generally flat top or outer surface 20 which extends to a rounded or chamfered corner 22 which protects the foil bag from tearing or ripping during subsequent assembly and sealing of the foil bag 10. This rounded edge 22 also protects the bag from tearing when pressure is applied to the bag to extrude material 12 out of the bag.

The chamfered corner 22 leads to a circular bottom edge 24 via an annular side wall 26. Side wall 26 together with the flat outer or top surface 20 defines a generally cup-shaped cylindrical recess 28. A spout collar 30 extends upwardly from one end portion of the outer or upper surface 20 of the adapter plate 14. Collar 30 includes a lower reinforcing and alignment boss or flange 32 and an upper alignment boss or flange 34. Flanges 32,34 are generally annular in shape and respectively limit the lower and upper edges of the annular tubular cylindrical collar 30 and define an annular recess between them.

A nozzle or spout 36 extends upwardly from the top of the collar 30. Nozzle 36 may be slightly tapered inwardly and upwardly so as to define a generally frustoconical form.

A cap 38 includes a main hollow body portion 40 similar to a thimble, a lower open end 42 and an upper closed end 44. An arched removal loop 46 may be formed over the closed upper end of the cap for facilitating removal of the cap from the nozzle 36 as discussed further below.

The internal side walls 48 of cap 38 may be tapered slightly inwardly from lower end 42 to upper end 44 so as to compliment and intimately engage the outer surface of spout 36 so as to form a tight, leak-resistant seal therewith.

As seen in FIG. 3, the cylindrical recess 28 in adapter plate 14 communicates with a central bore 50 which extends upwardly through both the collar 30 and nozzle 36. It can be appreciated that when the adapter plate 14 is pressed down over the flowable material 12 as shown in FIG. 4, the material 12 enters the cylindrical recess 28. Upon subsequent deformation of the bag 10 as discussed below, the flowable material is forced upwardly through central bore 50 so as to exit nozzle 36 and directly enter the intake port of a dynamic mixer or other dispensing apparatus.

Figure 5:
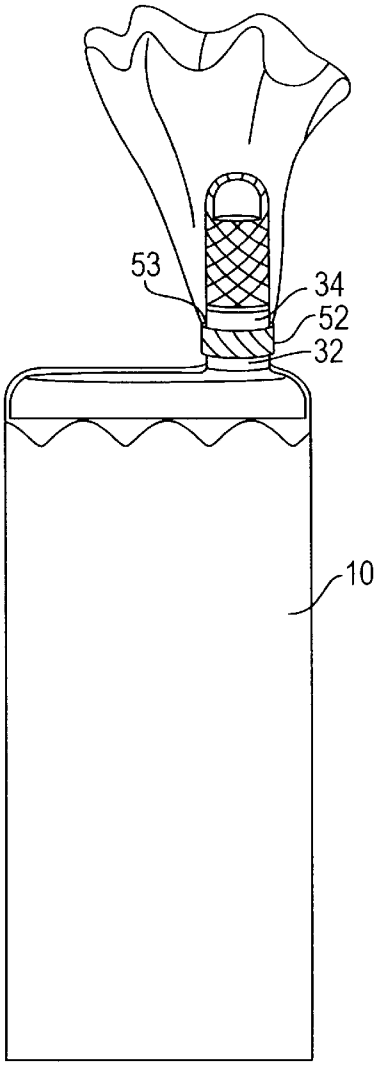
FIG. 5 is a view of the foil bag of FIG. 4 wherein the bag is sealed against the adapter plate with a ring clamp.

Once the adapter plate 14 is placed inside the bag 10 and pressed down on top of material 12, the top portion of the bag is tightly gathered around the collar 30 as seen in FIG. 5 and an external ring clamp 52 is tightly constricted around and secured against the bag 10 between the upper and lower collar flanges 32,34. Clamp 52 is preferably aligned in the annular recess between flanges 32,34 so as to axially constrain the clamp 52 therebetween.

Clamp 52 may take the form of any conventional sealing clamp such as various plastic and metal straps or bands readily available in the container industry. Clamp 52 is clamped with sufficient radially constricting force to form a permanent tight pressure-resistant first seal or spout seal 53 against the collar so as to prevent any of the flowable material 12 from extruding past the outer surface of the adapter plate. This ensures that the bag will not leak and cause a mess in the area surrounding spout 36.

It is important to note that the seal between the bag 10 and collar 30 can be maintained with a predetermined amount of force since the clamp 52 clamps the foil bag against the rigid, preferably plastic, material of the adapter plate 14. This is to be contrasted with prior designs which merely forced the plastic material against a housing using the variable or unknown application force of a piston or other actuator.

Figure 6:
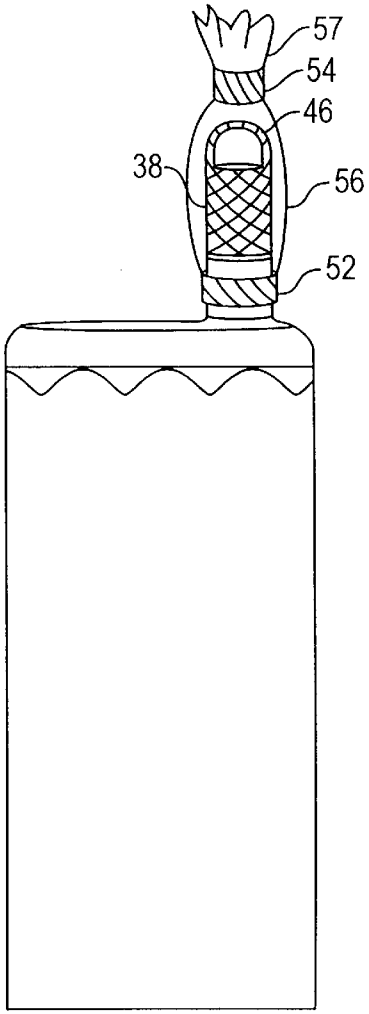
FIG. 6 is a view of the foil bag of FIG. 5 wherein the bag is sealed over the top of the adapter cap to retain the cap in place and to provide a double seal to the flowable material in the bag.

The next step in the assembly of the dispenser bag 10 is the formation of a removable or temporary second seal over the adapter. As seen in FIG. 6, after the cap 38 is snugly fit over the nozzle 36, the remaining material of bag 10 is gathered over the top of the cap 36 and tightly clamped against itself with a second ring clamp 54 similar to ring clamp 52 but having a smaller diameter. This second clamp forms a somewhat tubular or bulbous air-tight chamber 56 between the collar 30 and the top of cap 38.

The second clamp forms a second air-tight cap seal 57 by radially squeezing and compressing the bag material against itself. The lower edge of seal 57 preferably bears against the top of removal loop 46 of cap 38 and thereby maintains the cap 38 snugly in place over the nozzle 36. The foil bag as shown in FIG. 6 is ready to be shipped to an end user.

Figure 7:
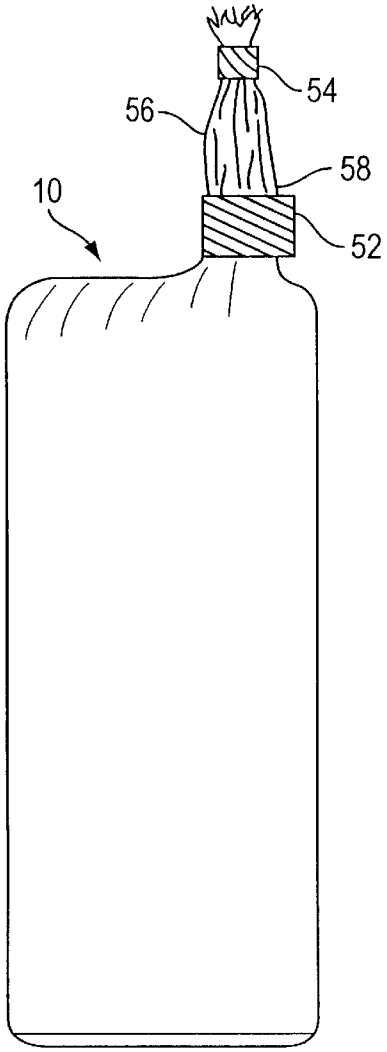
FIG. 7 is a view of a foil bag similar to FIG. 6 but constructed with an opaque bag material.

FIG. 7 shows a bag virtually identical to FIG. 6, however, the pliable material which forms bag 10 is shown as an opaque rather than a clear material. The material which extends between the lower clamp 52 and upper clamp 54 forms a somewhat tubular sealing chamber around cap 38 and pulls the cap downward over nozzle 36.

Figure 8:
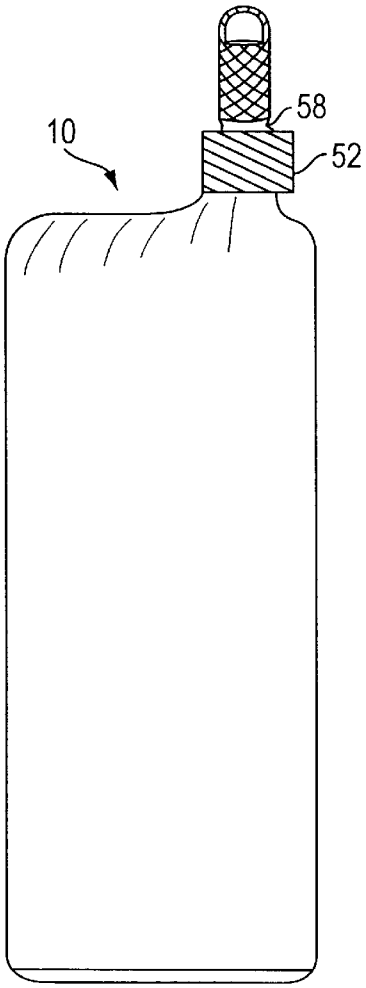
FIG. 8 is a view of the foil bag of FIG. 7 wherein the seal over the cap is cut away.

As seen in FIG. 8, once an end user receives the foil bag as constructed in FIG. 7, the tubular seal chamber 56 is cut circumferentially around its base 58 adjacent the top of the upper clamp 54 so as to expose the cap 38 and remove the second seal 57.

Figure 10:
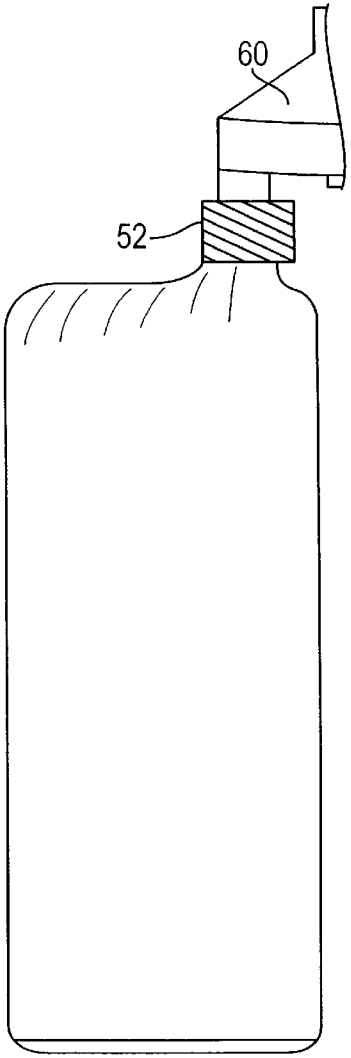
FIG. 10 is a view of the bag of FIG. 9 wherein the nozzle of the adapter plate is inserted into a dynamic mixer.
Figure 9:
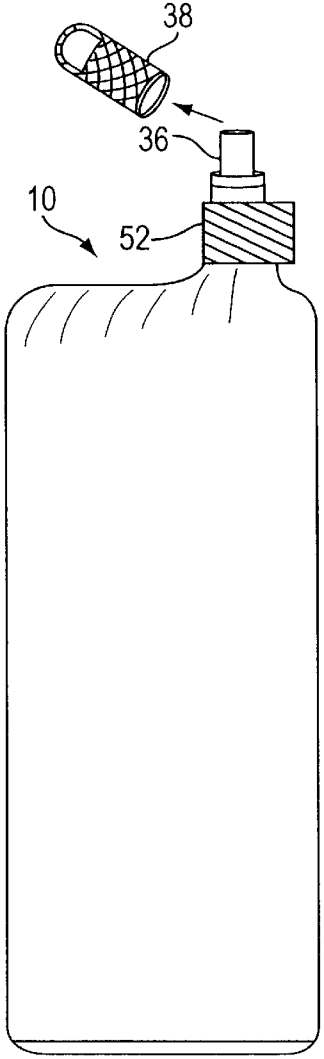
FIG. 9 is a view of the foil bag of FIG. 8 showing the removal of the adapter cap.
Figure 11:
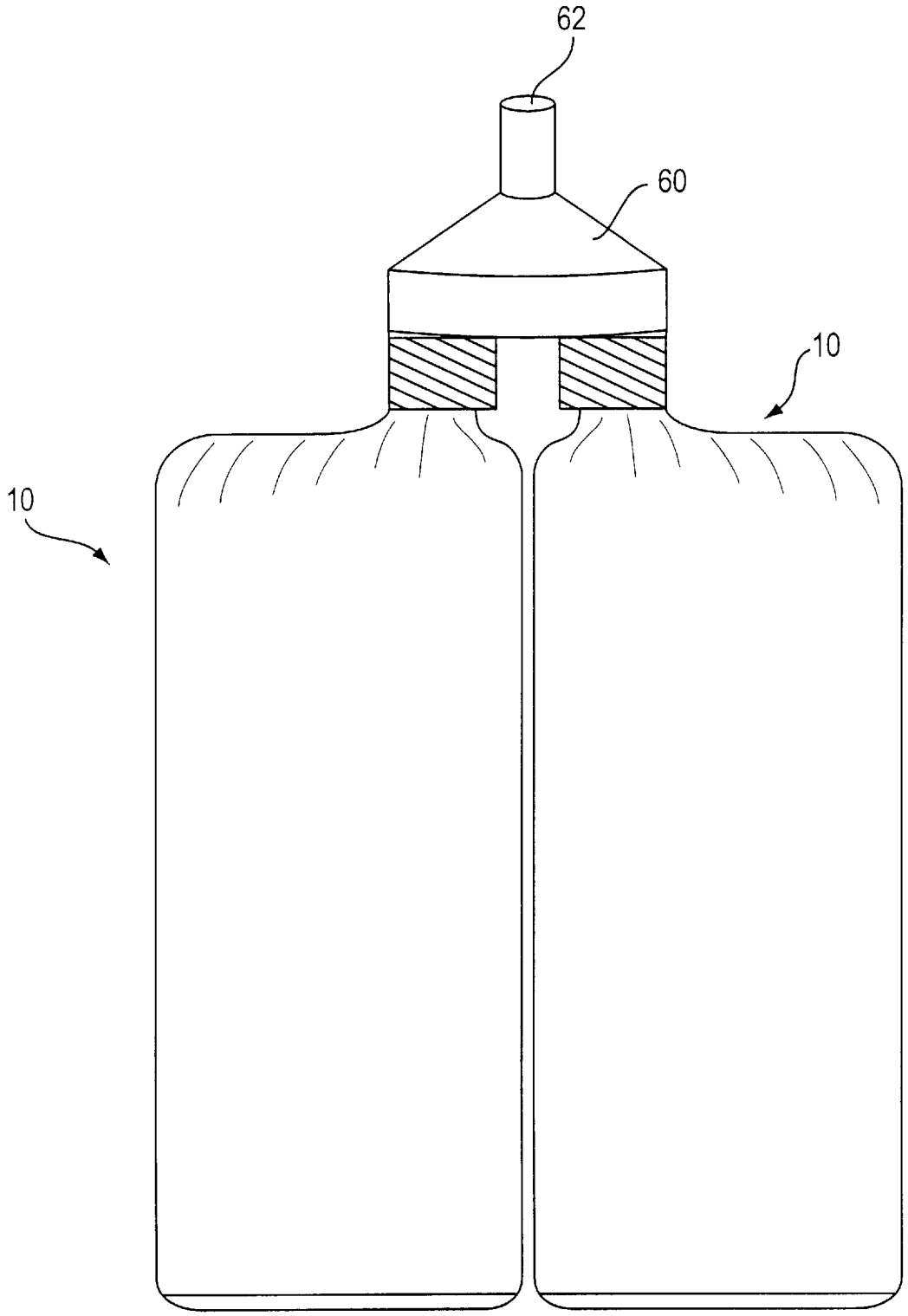
FIG. 11 is a view of one embodiment of a dynamic mixer wherein a pair of foil bags is attached thereto.

As seen in FIG. 9, the cap 38 is manually removed from the nozzle 36 thereby exposing the nozzle for insertion directly into a dispensing apparatus, such as the dynamic mixer 60, without any intervening plates, rings, adapters or the like as shown in FIG. 10. Although a single dispensing bag may be used in the dynamic mixer, it is more typical to use a pair of foil bags as shown in FIG. 11 wherein one foil bag may provide the base material of an epoxy adhesive and the other foil bag may provide the catalyst for setting the epoxy.

The dynamic mixer 60 is shown only schematically to indicate the general configuration of a pair of foil bags 10 having their respective nozzles inserted within intake ports within the dynamic mixer. The assembly shown in FIG. 11 may be inserted within the framework of a dispensing apparatus which applies pressure to the bottom portions of each foil bag such as with a piston. This squeezing action on the bags 10 extrudes the contents of each bag into the dynamic mixer from which a blended mixture exits through exit port 62. It should be noted that the nozzles on each adapter plate are asymmetrically offset from the longitudinal centerline of each bag and from the center of each circular lid on each adapter plate so as to allow for a closer spacing of the intake ports on the dynamic mixer and to avoid interference between the foil bags as they are inserted into the dynamic mixer.

Figure 12:
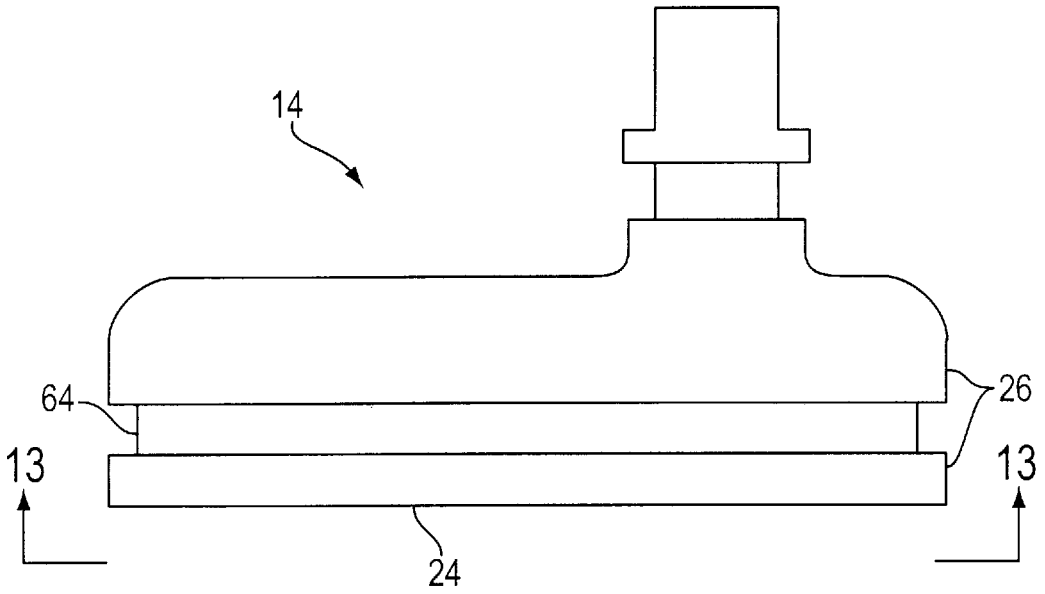
FIG. 12 is a front elevation view showing an alternate embodiment of an adapter plate constructed in accordance with the present invention.
Figure 13:
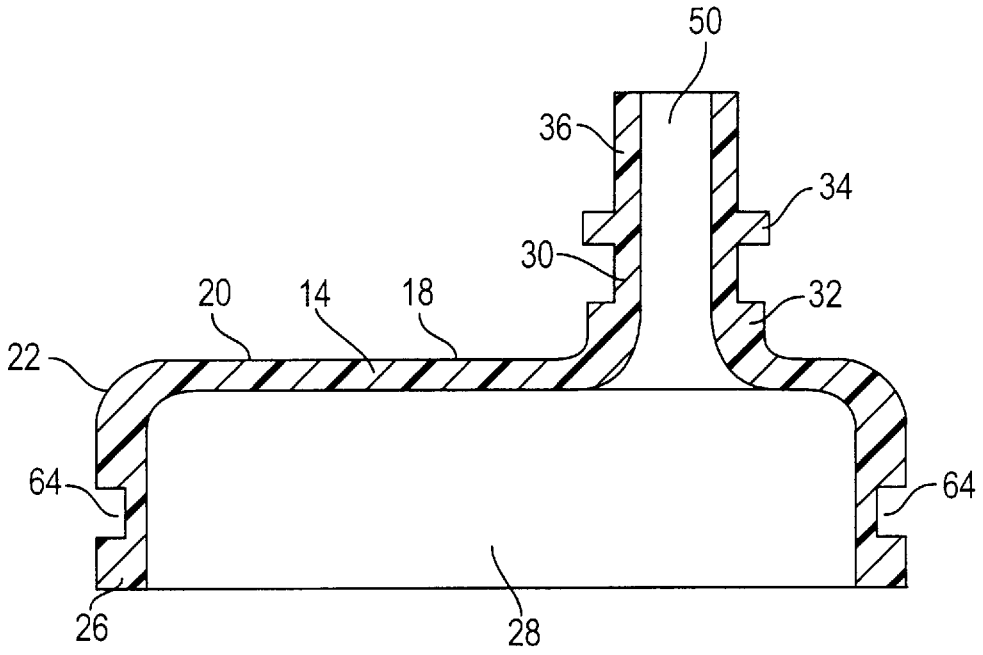
FIG. 13 is a view in section taken through section line 13—13 of FIG. 12.
Figure 14:
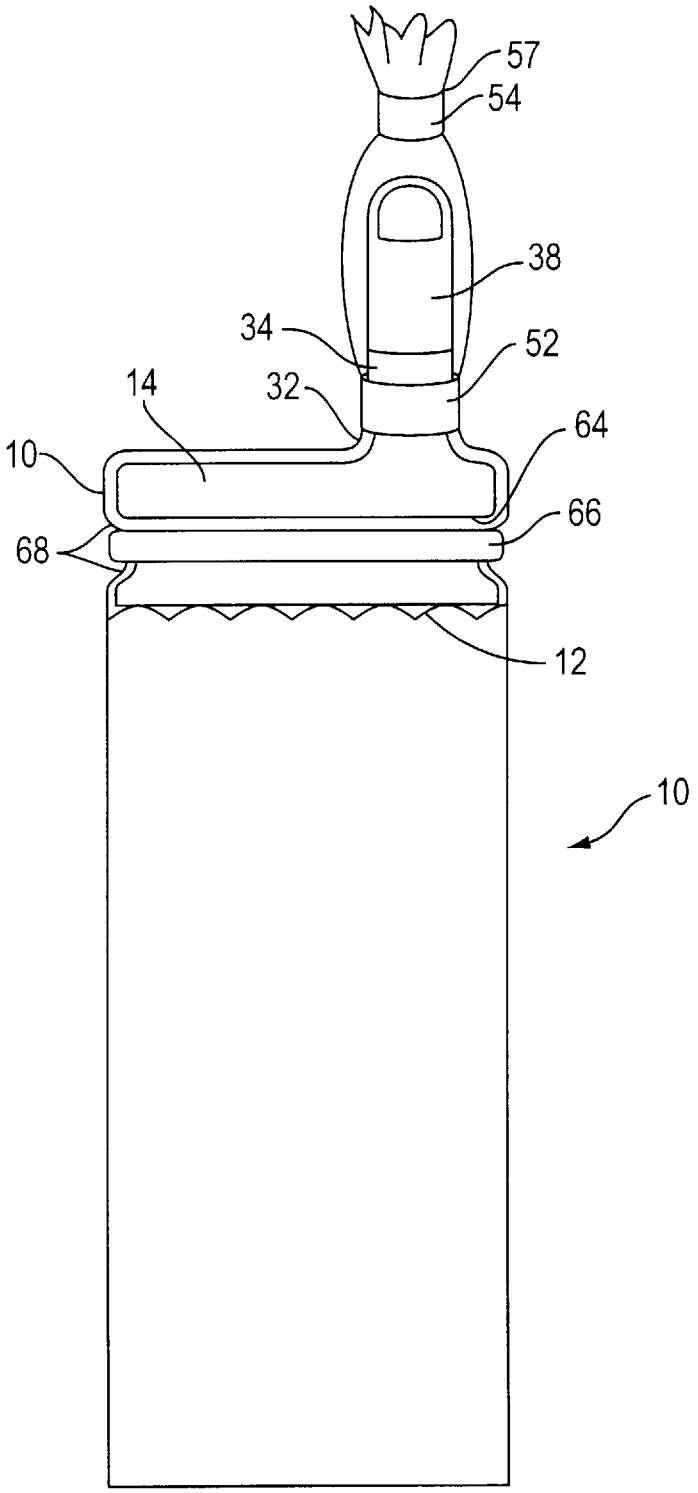
FIG. 14 is a front elevation view similar to FIG. 6 showing a foil bag fitted with the adapter plate of FIG. 12.

An alternate embodiment of the invention is depicted in FIGS. 12, 13 and 14 wherein the adapter plate 14 is modified to accommodate a third seal or base seal for preventing the flowable material 12 from being expressed between the foil bag 10 and the adapter plate 14. A circumferential or peripheral groove 64 is formed within and around side wall 26 of the adapter plate for receiving a third clamp band 66 as shown in FIG. 14.

Clamp band 66 may be a metal, plastic or elastic hoop tightly constricted around and within groove 64. Radial inward pressure applied by clamp band 66 crimps the bag 10 within groove 64 and against and around the sidewall 26 of the adapter plate 14. This clamping action forms a tight third seal or sidewall seal 68 between the bag 10 and the adapter plate 14 and prevents the flowable material from being squeezed upwardly around and past the outer surface of sidewall 26. Other than the formation of groove 64, the adapter plate 14 in this embodiment is substantially the same as that discussed above.

There has been disclosed heretofore the best embodiment of the invention presently contemplated. However, it is to be understood that various changes and modifications may be made thereto without departing from the spirit of the invention.

What is claimed is:

1. A dispensing assembly, comprising:

a bag formed of a deformable material for containing a flowable material within said bag;

an adapter plate provided within said bag for resting on said flowable material;

a spout extending from said adapter plate; and a first seal formed around said spout by said bag for sealing said bag.

2. The assembly of claim 1, further comprising a removable cap mounted over said spout.

3. The assembly of claim 1, further comprising a second seal formed above said spout.

4. The assembly of claim 3, wherein said second seal comprises a clamp clamping said deformable material against itself.

5. The assembly of claim 1, wherein said adapter plate comprises a top wall, a sidewall and a rounded corner portion interconnecting said top wall and said sidewall.

6. The assembly of claim 1, wherein said spout is disposed asymmetrically on said adapter plate.

7. The assembly of claim 1, wherein said first seal comprises a clamp clamping said bag against said spout.

8. The assembly of claim 1, wherein said spout comprises a spout collar having first and second spaced apart flanges and wherein said first seal comprises a first clamp clamping said bag against and around said spout collar between said first and second flanges.

9. The assembly of claim 8, further comprising a second seal formed above said spout comprising a second clamp clamping said material against itself and defining a tubular chamber surrounding said spout.

10. The assembly of claim 1, further comprising a dispensing apparatus having an intake port formed therein and wherein said spout is inserted directly into said intake port.

11. The assembly of claim, 10, wherein said dispensing apparatus comprises a dynamic mixer.

12. A dispensing assembly, comprising:

a bag for containing a flowable material;

an adapter plate provided within said bag, said adapter plate comprising a lid and a spout extending from said lid;

a first seal formed around said spout by said bag; and a second seal formed over said spout by said bag.

13. The assembly of claim 12, wherein said first seal comprises a first clamp clamping said bag to said spout.

14. The assembly of claim 12, wherein said second seal comprises a second clamp clamping and constricting said bag against itself.

15. The assembly of claim 12, further comprising a removable cap fitted on said spout.

16. The assembly of claim 12, wherein said lid comprises a circular lid and wherein said collar is disposed asymmetrically on said lid.

17. The assembly of claim 12, further comprising a chamber formed by said bag between said first and second seals.

18. The assembly of claim 12, wherein said adapter plate comprises a sidewall extending from said lid and a chamfered corner extending between said lid and said sidewall.

19. The assembly of claim 12, wherein said first seal comprises a permanent seal and said second seal comprises a removable temporary seal.

20. The assembly of claim 12, further comprising a cap fitted over said spout and held on said spout by said second seal.

21. A dispensing assembly, comprising:

a bag;

an adapter plate provided within said bag, said adapter plate comprising a spout and a sidewall; and a sidewall seal formed around said sidewall for sealing said bag.

22. The assembly of claim 21, wherein said sidewall has a groove formed therein and said sidewall seal comprises a clamp clamping said bag within said groove and against said sidewall.

23. The assembly of claim 21, further comprising a spout seal formed around said spout by said bag.

24. The assembly of claim 23, further comprising a cap fitted over said spout and a cap seal formed over said cap by said bag.

25. An adapter plate for use within a bag containing flowable material, comprising:

a top wall, a sidewall and a rounded corner portion interconnecting said top wall and said sidewall;

a spout extending from said top wall, said spout having a spout collar with means for constraining, in use, a clamping means for sealing said bag to said spout.

26. An adapter plate as in claim 25, wherein said means for constraining includes a first flange and a second flange, said flanges being spaced apart for receiving, in use, said clamping means therebetween.

27. The adapter plate as in claim 25, further comprising a removable cap mounted over said spout.

* * * * *